US006256946B1

(12) United States Patent
Kennedy et al.

(10) Patent No.: US 6,256,946 B1
(45) Date of Patent: Jul. 10, 2001

(54) ADJUSTABLE STAIRWAY FOR USE WITH AN OVERCAST IN A MINE

(75) Inventors: William R. Kennedy; John M. Kennedy, both of Taylorville, IL (US)

(73) Assignee: Jack Kennedy Metal Products and Buildings, Inc., Taylorville, IL (US)

( * ) Notice: Subject to any disclaimer, the term of this patent is extended or adjusted under 35 U.S.C. 154(b) by 0 days.

(21) Appl. No.: 09/411,084

(22) Filed: Oct. 4, 1999

(51) Int. Cl.[7] ..... E04F 11/06
(52) U.S. Cl. ..... 52/183
(58) Field of Search ..... 52/183, 191

(56) References Cited

U.S. PATENT DOCUMENTS

| | | | |
|---|---|---|---|
| 1,235,411 | 7/1917 | Andrews . | |
| 2,498,375 | 2/1950 | Moore . | |
| 3,367,444 | 2/1968 | Meddick . | |
| 3,626,438 | 12/1971 | Cornell et al. | 52/183 |
| 3,713,511 | 1/1973 | Hinkle | 182/95 |
| 3,731,761 | 5/1973 | Glenn | 182/1 |
| 3,765,137 | 10/1973 | Loix | 52/182 |
| 3,885,365 | 5/1975 | Cox | 52/183 |
| 3,962,838 | 6/1976 | Cox | 52/183 |
| 4,124,957 | 11/1978 | Poulain | 52/183 |
| 4,249,634 | 2/1981 | Potts | 182/1 |
| 4,406,347 | 9/1983 | Stathopoulos | 52/183 X |
| 4,421,206 | 12/1983 | Kummerlin | 182/156 |
| 4,959,935 | 10/1990 | Stob | 52/183 |
| 5,466,187 | 11/1995 | Kennedy et al. | 454/169 |

FOREIGN PATENT DOCUMENTS

| | | | |
|---|---|---|---|
| 2023574 | * 12/1991 | (CA) | 52/183 |
| 810618 | 8/1957 | (GB) . | |

OTHER PUBLICATIONS

Search Report Under Section 17, 02/21/01 from U.K. Analog Application with und.

* cited by examiner

*Primary Examiner*—Peter M. Cuomo
*Assistant Examiner*—Rodney B. White
(74) *Attorney, Agent, or Firm*—Senniger, Powers, Leavitt & Roedel

(57) ABSTRACT

An overcast system for a mine is disclosed. The system includes and overcast positioned at an intersection of mine passageways and operable to direct airflow through the passageways in a desired flow pattern at the intersection. Stairways are positioned adjacent opposite sides of the overcast providing a means for people to traverse between the opposite sides of the overcast. The stairways are self adjusting to accommodate overcasts of different heights while providing generally horizontal steps. The stairways are constructed with knockdown assembly means to provide for easy assembly and disassembly in the mine.

39 Claims, 10 Drawing Sheets

100
96
24
85
70
100
58
101
98
96
97
94
98
63R
99
101
34
97
58
54
32
82
30
58
63L
51
22
56
72
31
70
52

70
85
83
83
82
58
134
70
114
82
132
82
136
56
58
83
104

58
65
112
111
60
113
110
104
111
109

ADJUSTABLE STAIRWAY FOR USE WITH AN OVERCAST IN A MINE

BACKGROUND OF THE INVENTION

This invention relates generally to an overcast system for use at an intersection of passageways in a mine. The overcast system includes adjustable stairways positioned adjacent to an overcast structure allowing people to cross over the overcast for passage along a mine passageway.

Overcasts are used in mines at passageway intersections to prevent mixture of ventilation air flow in the intersecting passageways and to maintain airflow along the desired path within a mine. An overcast is a tunnel structure that forms a flow conduit connecting two sections of a first passageway at an intersection of the first passageway with a crossing or intersecting second passageway. The overcast includes a pair of generally parallel spaced apart upstanding side walls and a deck or roof extending between and secured to the side walls. The side walls and deck form a flow conduit (tunnel) communicating between the sections of the first passageway. End and wing panels are used in combination with the overcast to form an overcast system that substantially closes off flow communication between the first and second passageways at their intersection. The normal airflow pattern is to have inlet air flowing through the overcast and return air flowing over the overcast. However, under certain circumstances, the airflow could be reversed. Overcast systems are known in the art as exemplified in U.S. Pat. No. 5,466,187 the disclosure of which is incorporated herein by reference. An airflow segregating structure like an overcast may also be erected by first excavating the mine floor. The deck is positioned over at least a portion of the excavated area and could be closer to the original floor than a typical overcast. This type of structure is referred to as an undercast. An undercast can use any suitable deck support erected adjacent opposite sides of the excavation to support the deck. Such support can be erected in the excavation and/or erected to the side of the excavation on the original mine floor. Such support can be, e.g., a block wall or could also be length extensible steel panels like those used to form stoppings as are known in the art. As used herein, the overcasts and undercasts will be referred to as air crossings.

Air crossing systems are effective to segregate the airflows between the first and second passageways at the intersection. However, they limit the ability of miners to utilize the second passageway since a wall is created across the second passageway. Personnel have found ways to get around the air crossing systems including some ways that may not be safe or reliable. Many times personnel will maneuver through gaps in the walls of the air crossing or in the wing panels sealing the air crossing to the mine walls. Sometimes ramps are formed at the air crossing sidewalls with back fill. Ladders could likewise be used, but mine floors can be rough and uneven making use of a ladder difficult and possibly dangerous. None of the foregoing ways of circumventing an air crossing would be very effective in the event an injured miner needs to be evacuated from the mine or if an emergency evacuation is needed.

The use of permanent and semipermanent structures in mines presents difficulty because mines are not static in their size and shape. Common phenomenon in mine passageways is convergence and divergence of the mine walls, floor and roof. A mine passageway will change in size and shape, sometimes significantly, due to the weight of the overburden over the mine passageway. The walls, floor and/or the roof may converge inwardly into the passageway. Also, and less frequently, the walls, floor and/or roof may diverge making the passageway larger. Both convergence and divergence may occur in a passageway. As used herein, the phrase "dimensional instability" includes both convergence and divergence.

Dimensional instability can cause problems with any structure installed in a mine passageway. Structures may shift or try to change dimensions or become separated from a wall, floor, roof or one another. The position of a structure may also change. Dimensional instability presents potential structural integrity problems for any structure positioned in a mine particularly with the ability of a mine to apply tremendous forces to a structure. Thus, mine equipment has special design needs to be able to accommodate dimensional instability. For example, an opening or door in an air crossing may not be available or workable from time to time, because of structural movement or improper maintenance, as a means to cross from one side of an air crossing to the other side. Further, equipment such as conveyors may be positioned in the air crossing preventing a miner from traversing across the air crossing from side to side. High airflow rates and pressure differentials can also make doors difficult to use. In the event of an emergency, structures must work reliably to reduce risks by allowing personnel unimpeded and safe passage through a passageway. Likewise, in the performance of normal duties, structures should not be an impediment to miners.

Thus, there is a need for an air crossing system which controls airflow in a mine but which can be easily traversed by crossing over in one passageway and passing through in an intersecting passageway. The present invention utilizes a deck structure with an automatically adjustable stairway to form a walkway for conveniently and safely traversing from one location in a mine to another including the use of such structure as an air crossing or as a walkway to cross over mine equipment like large conveyor belts.

SUMMARY OF THE INVENTION

Among the several objects and features of the present invention may be noted the provision of a deck structure that can be used as a walkway that will accommodate dimensional instability of the mine passageway; the provision of a deck structure that permits safe and convenient traversing from one location in a mine to another; the provision of such a deck structure with an automatically adjustable stairway system that will accommodate dimensional instability; the provision of such a deck structure as an air crossing system that provides for reliable traversing thereof through both the first and second passageways the provision of a such a stairway that can be used at various angles of inclination up to vertical for traversing the air crossing; the provision of such a stairway that utilizes the air crossing for orienting the steps of the stairway generally horizontally; the provision of such a stairway that can be freestanding and positioned adjacent a deck of the air crossing; the provision of such a stairway that is height adjustable for use with a variety of different height air crossings; the provision of such a stairway that can be used either free standing or secured to an air crossing; the provision of an air crossing system utilizing one or more automatically adjustable stairways to provide a means to traverse an air crossing; and the provision of a stairway that accommodates uneven floors, different height air crossings, changes in height of the air crossing and is durable in operation in a mine environment.

The present invention involves the provision of a stairway for a mine air crossing installed in a mine passageway. The stairway comprises a pair of elongate generally parallel supports at opposite sides of the stairway. Each support includes upper and lower parallel stringers disposed one above the other at a respective side of the stairway. A plurality of generally horizontal steps extend between the supports, each step having a front edge, a rear edge, and opposite ends positioned adjacent respective supports. Two horizontal pivot connections are provided between each end of each step and the upper and lower stringers of a respective support to form parallelograms at opposite sides of the stairway whereby the steps remain generally horizontal regardless of the angle of inclination of the stairway and regardless of a mine convergence or divergence causing a longitudinal shift of an upper stringer relative to a lower stringer. Handrails are mounted on the steps at opposite sides of the stairway. Each handrail has a plurality of generally vertical posts each having a lower end attached to a respective step and an upper end, and a hand bar having generally horizontal pivot connections with the vertical posts adjacent their upper ends. The hand bars are removable from respective posts so that when the stairway is moved to a position in which said supports are vertical, said vertical posts of the handrails are positioned to be grasped by a person climbing the stairway.

The present invention also involves the provision a stairway for a mine air crossing installed in a mine passageway. The stairway comprises a pair of elongate generally parallel supports at opposite sides of the stairway. Each support comprises upper and lower parallel stringers disposed one above the other at a respective side of the stairway, the supports having opposing inside faces defining an interior space therebetween. A plurality of generally horizontal steps extend between the inside faces of the supports, each step having a front edge, a rear edge, and opposite ends positioned adjacent respective supports. Two horizontal pivot connections are provided between each end of each step and the upper and lower stringers of a respective support to form parallelograms at opposite sides of the stairway whereby said steps remain generally horizontal regardless of the angle of inclination of the stairway and regardless of a mine convergence or divergence causing a longitudinal shift of an upper stringer relative to a lower stringer. The horizontal pivot connections comprise knock-down connections configured for easy assembly and disassembly of the stairway, said knock-down pivot connections comprise a plurality of holes in the stringers and a plurality of pivot members removably attachable to respective steps and stringers. The pivot connections are securable from a position outside the interior space to facilitate assembly and disassembly of said stairway in a mine.

The present invention also provides a stairway for a mine air crossing installed in a mine passageway. The stairway includes a pair of elongate generally parallel supports at opposite sides of the stairway, each support comprising upper and lower generally parallel stringers disposed one above the other at a respective side of the stairway. A plurality of generally horizontal steps extend between the supports, each step having a front edge, a rear edge, and opposite ends positioned adjacent respective supports. Two generally horizontal pivot connections are provided between each end of each step and the upper and lower stringers of a respective support to form parallelograms at opposite sides of the stairway whereby said steps remain generally horizontal regardless of the angle of inclination of the stairway and regardless of a mine convergence or divergence causing a longitudinal shift of an upper stringer relative to a lower stringer. A generally horizontal landing is attached to the supports at upper ends thereof. Means is provided for fastening the landing to an upper surface of the air crossing thereby to secure the stairway to the air crossing and set the angle of inclination of the steps.

A stairway for a mine air crossing installed in a mine passageway is provided. The stairway includes a pair of elongate generally parallel supports at opposite sides of the stairway, each support comprising upper and lower parallel stringers disposed one above the other at a respective side of the stairway. A plurality of generally horizontal steps extend between the supports, each step having a front edge, a rear edge, and opposite ends positioned adjacent respective supports. Two generally horizontal pivot connections between each end of each step and the upper and lower stringers of a respective support to form parallelograms at opposite sides of the stairway whereby the steps remain generally horizontal regardless of the angle of inclination of the stairway. A pair of variable length columns are provided, each mounted on a said step adjacent upper ends of the supports, said columns having lower ends for resting on a mine floor to at least partially support the steps and supports.

The present invention involves an air crossing system for a mine. The air crossing system includes a pair of generally vertical sidewalls with upper edges, the sidewalls are in spaced apart relation. A deck extends between the sidewalls and is secured thereto adjacent the upper edges of the sidewalls. A stairway is positioned adjacent to at least one of the sidewalls and includes a pair of elongate generally parallel supports at opposite sides of the stairway, each support comprising upper and lower stringers disposed one above the other at a respective side of the stairway. A plurality of generally horizontal steps extend between the supports, each step having a front edge, a rear edge, and opposite ends positioned adjacent respective supports. Two pivot connections are provided between each end of each step and the upper and lower stringers of a respective support form parallelograms at opposite sides of the stairway whereby the steps remain generally horizontal regardless of the angle of inclination of the stairway.

The present invention also involves a stairway for use with an elevated deck in a mine to form a walkway extending over an area to be traversed. The stairway includes a pair of elongate supports at opposite sides of the stairway, each support comprising upper and lower stringers disposed one above the other at a respective side of the stairway. A plurality of generally horizontal steps extend between the supports, each step having a front edge, a rear edge, and opposite ends positioned adjacent respective supports. Two generally horizontal pivot connections are provided between each end of each step and the upper and lower stringers of a respective support to form parallelograms at opposite sides of the stairway whereby the steps remain in a generally horizontal orientation regardless of the angle of inclination of the stairway. Retaining means is secured to the stairway adjacent to an upper step of the stairway for retaining the steps in a fixed angular position relative to the deck.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
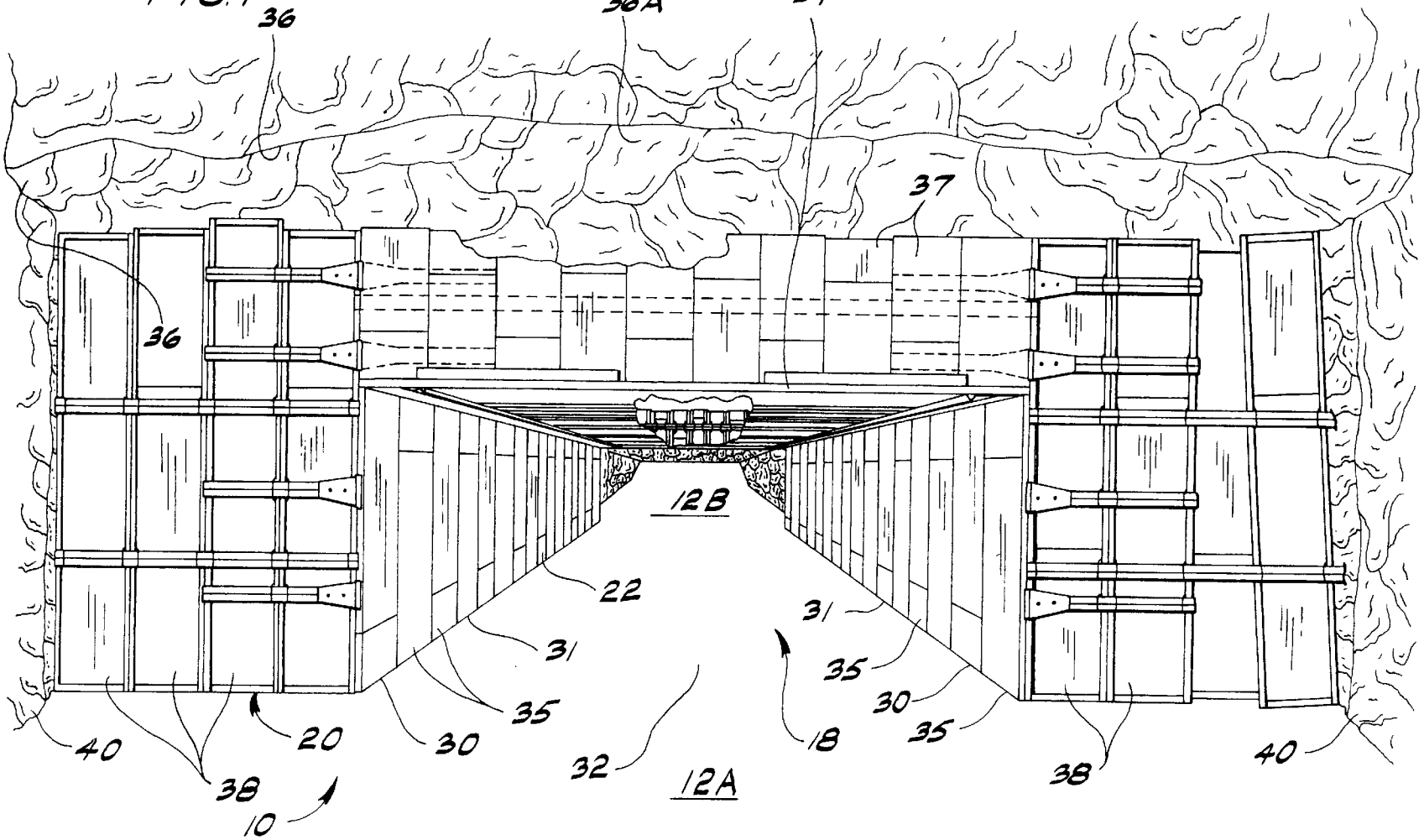
FIG. 1 is a perspective view of an air crossing system including an air crossing positioned in intersecting passageways in a mine.

Referring to the drawing (FIGS. 1, 2) a mine, designated generally as 10, and as shown includes at least two passageways 12, 14 crossing at an intersection 18. The passageways 12, 14 have sections 12A, 12B and 14A, 14B respectively on opposite sides of the intersection 18. A deck structure system which is shown as an air crossing system designated generally as 20, is positioned in the mine 10 in the intersection 18. The air crossing system 20 includes a deck structure which in one embodiment, and as shown is an air crossing 22. The air crossing 22 is illustrated as an overcast and includes a pair of adjustable stairways, each designated generally 24, mounted on opposite sides of the air crossing 22. The air crossing system 20 maintains the airflow streams in the passageways 12, 14 substantially separate at the intersection 18 to maintain the air flowing in the desired flow pattern in the mine. The present invention will be described as an overcast, however it is envisioned that the deck structure could be utilized as an undercast. Further, if regulation of air flow is not a requirement, the deck structure can be utilized as an elevated walkway to traverse over an area in the mine from location to another. For example, the deck structure could be used as a walkway or crossing to move from one side of machinery or equipment, like a conveyor belt, to the other side.

The air crossing 22, in the preferred embodiment, extends between the passageway sections 12A, 12B and forms a flow conduit for conducting air from passageway section 12A to section 12B. The air crossing 22 substantially prevents the air flowing therethrough from flowing into the passageway sections 14A, 14B at the intersection 18 and likewise prevents air from flowing from the passageway sections 14A, 14B to the passageway sections 12A, 12B at the intersection. It is to be noted however, that the passageway sections 12A, 12B can be in flow communication with the passageway sections 14A, 14B elsewhere in the mine 10. The normal airflow pattern is such that inlet air flows through the air crossing 22 and passageway 12 and return air flows over the air crossing 22 and through the passageway 14. However, the air flow pattern could be the reverse as described above.

Figure 2:
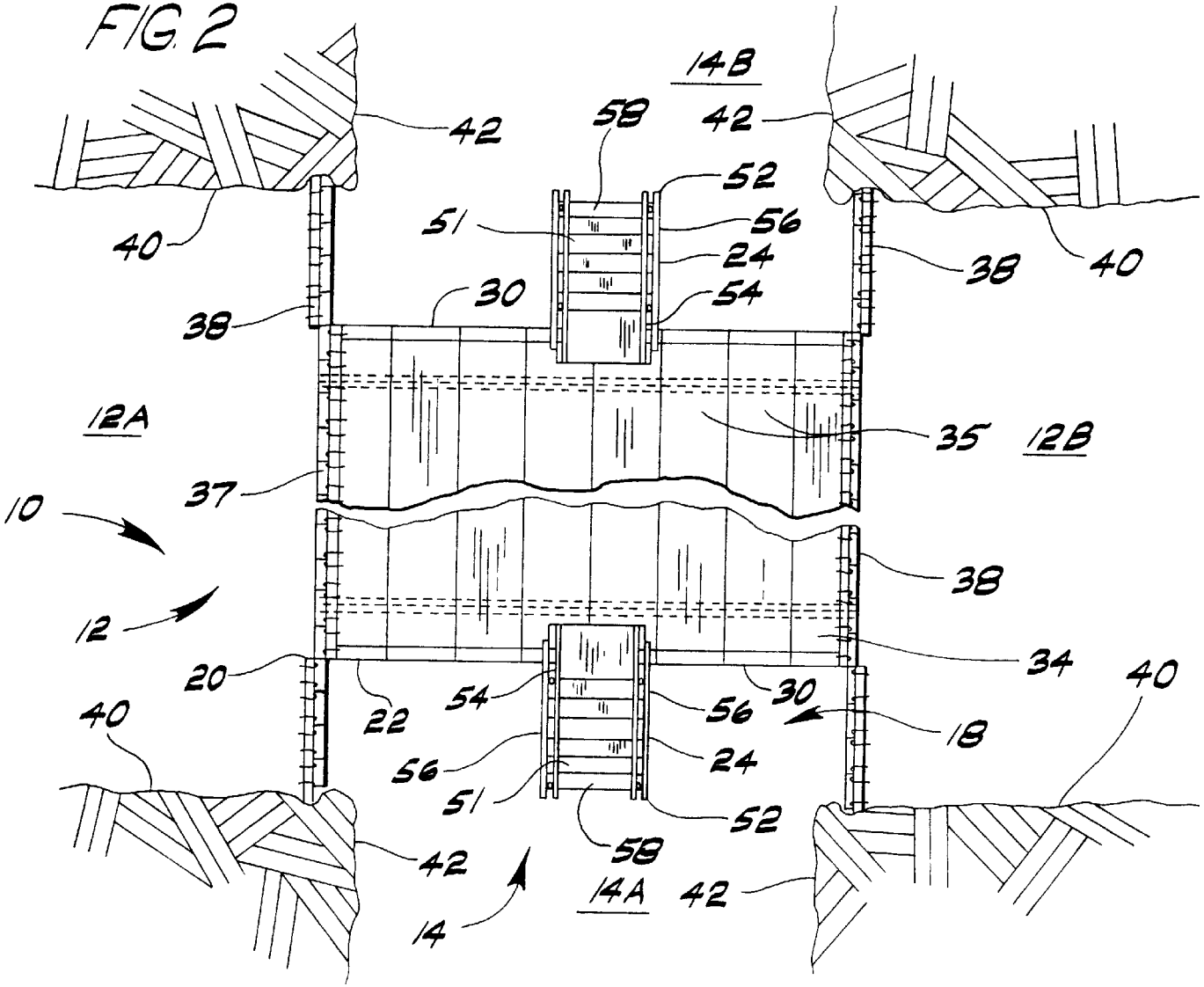
FIG. 2 is a plan view of the air crossing system of FIG. 1.

As seen in FIGS. 1, 2, the air crossing 22 includes a pair of spaced apart side supports such as sidewalls 30 which are erected in the mine 10 in the intersection 18. The sidewalls 30 extend between the mine sections 12A, 12B and across the ends of the mine sections 14A, 14B at the intersection 18. The sidewalls 30 are generally vertical having bottom edges 31 in engagement with a mine floor 32. The air crossing 22 also includes a top deck or roof 34 extending between and secured to the sidewalls 30 at upper edges 33 of the sidewalls 30. Preferably, the deck 34 and sidewalls 30 form a deck structure and are preferably comprised of a plurality of side-by-side, length adjustable panels 35 secured together as is known in the art and as described in U.S. Pat. No. 5,466,187. In a preferred embodiment, the deck 34 is generally flat and generally horizontal while the walls 30 are generally flat and generally vertical. The present invention also envisions air crossings 22 of different shapes and configurations. For example, the air crossing 22 could have an arched deck 34, or could be in the form of a squash culvert or pipe. If an air crossing 22 does not have a flat deck, a platform (not shown) could be erected on the air crossing for each stairway 24 to provide a relatively flat surface to affix the stairway to. The mine 10 includes a roof 36 defining the top of the passageways 12A, 12B, 14A, 14B and the intersection 18. To provide clearance for traversing the deck 34 of the air crossing 22, a mine roof section 36A above the intersection 18 can be excavated elevating the mine roof section above the deck 34 for clearance therebetween. The deck 34 and stairways 24 form an elevated walkway. As discussed above, if the deck structure is to be used as an elevated walkway to traverse equipment, machinery or other obstacles, it can be erected anywhere in a mine and need not be located at an intersection of passageways.

As also seen in FIGS. 1, 2 the air crossing system 20 includes end and wing panels 37, 38 respectively, extending between the air crossing 22, in particular, the sidewalls 30 and deck 34, and mine walls 40, 42, roof 36 and floor 32 at each end of the air crossing. The end and wing panels 37, 38, in cooperation with the deck 34 and walls 30, close the remaining flow paths between the passageways 12, 14 around the air crossing 22 to complete the air flow separation at the intersection 18. Alternatively, the air crossing 22 can be longer than the intersection 18 thereby having end portions extending into the passageway sections 12A, 12B. By proper sizing of the walls 30 and deck 34, the end and wing panels 37, 38 need not be used. The mine walls 40, 42 are oftentimes more stable farther from the intersection 18 and therefore do not necessarily require the automatic size adjustability of the end and wing panels 37, 38.

Figure 3:
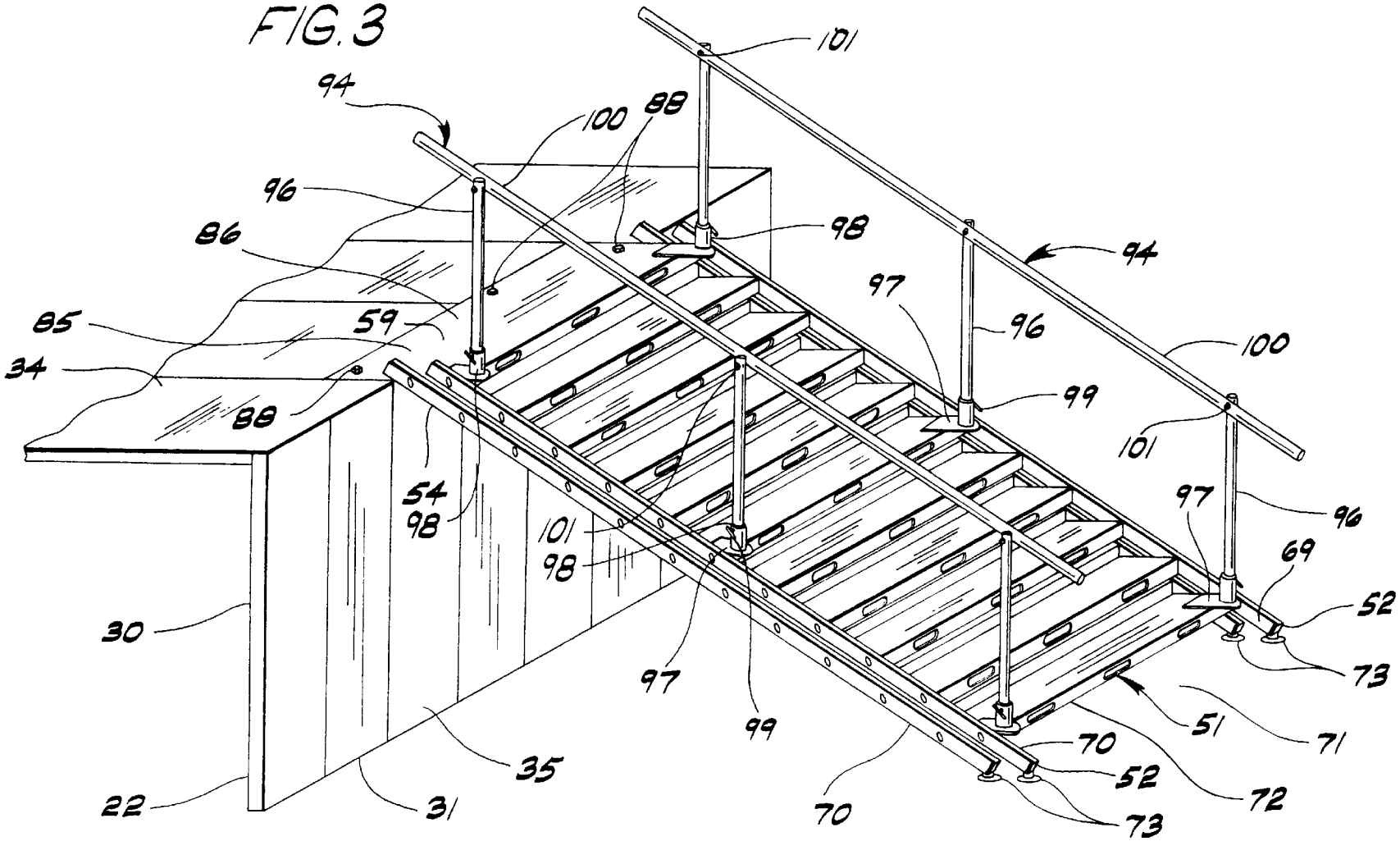
FIG. 3 is an enlarged perspective view of a stairway as shown in FIG. 1 showing the stairway in a normally inclined orientation.
Figure 5:
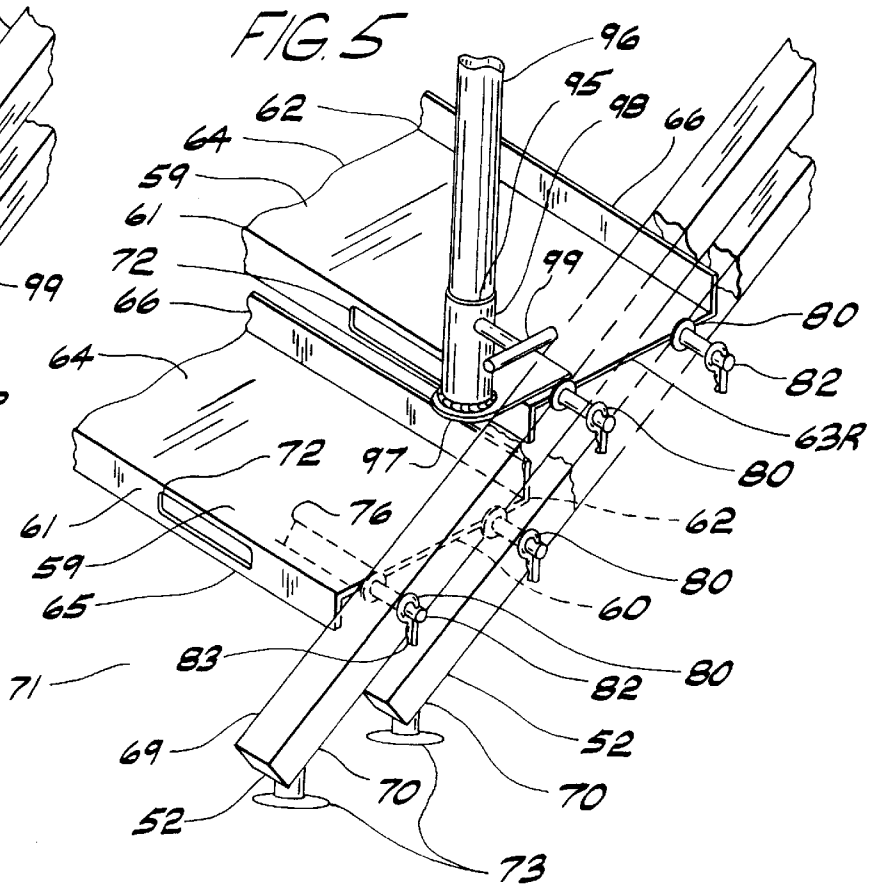
FIG. 5 is an enlarged fragmentary perspective view of the stairway showing details of the mounting of steps and handrail to a step support.
Figure 6:
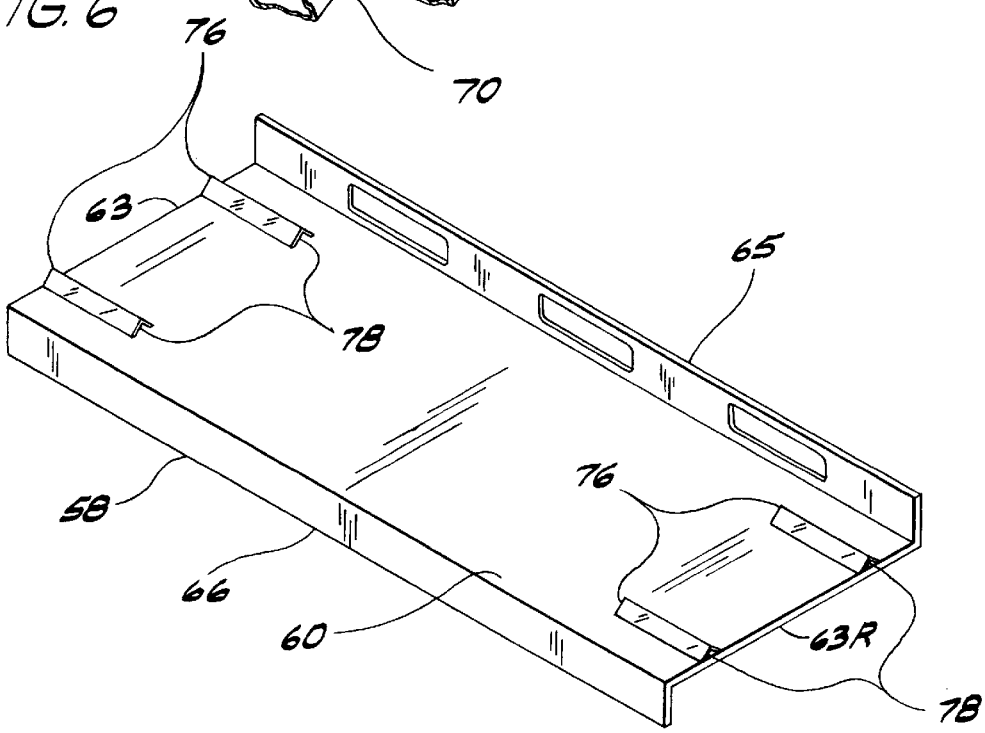
FIG. 6 is an enlarged fragmentary bottom view of a step showing detail of the pivotal step mount arrangement of the structure of FIG. 5.

As illustrated in FIG. 3, the stairway 24 includes a tread section 51 with a lower end 52 adapted to rest on the mine floor 32 and an upper end 54 adapted to be supported in an elevated position adjacent the deck 34. The tread section 51 is automatically adjustable to accommodate different heights of air crossings 22. The tread section 51 includes a pair of spaced apart side supports 56 with a plurality of steps or treads 58 pivotally mounted thereon and extending between the supports 56. The steps 58, FIGS. 5, 6, are generally Z shaped in transverse cross section, each comprising relatively wide tread panels having a top surface 59, a bottom surface 60, a front (nose) edge 61, a back edge 62 and opposite ends 63L, 63R. A front flange 65 depends from the panel 64 adjacent the front edge 61, and a back flange 66 extends up from the panel 64 adjacent the back edge 62. Hand holes 72 can be provided through the front flanges to facilitate use of the stairway. It is preferred that the top step 58 not have a back flange 66 to eliminate a tripping hazard. The steps 58, in use, are generally horizontal end-to-end and front to back. In a preferred embodiment, for a tread panel 64 width having a back-to-front width of about 9 ½ inches, the top surface 59 will incline slightly downwardly from the back edge 62 to the front edge 61 a distance of up to about ⅜" and preferably in the range of about ¼" through about ⅜" or at an angle in the range of about 1° through about 3°. It has been found that such an incline makes the stairway easier to traverse by reducing tripping on the front edge 61 and also improves water run off from the steps 58. The steps 58 are preferably made of steel.

The steps 58 are pivotally mounted on the supports 56 and form a parallelogram with each support 56 allowing movement of the steps in unison while being retained in a preferred generally parallel relationship. As seen in FIG. 3, each support 56 includes a pair of spaced apart elongate stringers 70 disposed one generally above the other in a generally vertical plane. The stringers 70 are also preferably generally parallel. The pairs of stringers 70 have inside faces 69 defining an interior space 71 therebetween in which the steps 58 are positioned, opposite ends 63L, 63R of the steps being positioned adjacent respective stringers 70. The stringers 70 are structural members such as square tubes made of steel. The lower end 52 of the stairway 24 can be provided with height adjustable pads 73, FIG. 3, secured to the stringers 70 to compensate for an uneven mine floor 32. Shims (not shown)could be used instead of the pads 73 to compensate for such unevenness. Wheels or skid plates (not shown) could also be used in place of the pads 73 to facilitate movement of the lower end 52 along the mine floor 32.

The steps 58 are pivotally mounted on the stringers 70 preferably utilizing two generally horizontal pivoting connections on each end 63L, 63R of each step 58. It is preferred that the pivotal mounting be of a knock down type to provide easy assembly and disassembly of the stairway 24 in a mine 10. FIGS. 5, 6 show one form of pivotal mounting. Channel members 76, such as angles, are affixed to the bottom surfaces 60, as by welding. As shown, two pairs of channels 76 are secured to each step 58. One pair of channels 76 is positioned adjacent each step end 63L, 63R with one of the two channels in a pair being positioned adjacent the front edge 61 and the other being positioned adjacent the back edge 62. The channels 76 adjacent the front edge have aligned bores 78 to define a first pivot axis extending lengthwise of the step 58 and the channels 76 adjacent the back edge have aligned bores 78 defining a second pivot axis generally parallel to the first pivot axis.

The stringers 70 are perforated with apertures 80 extending between opposite sides of the stringers 70. The apertures 80 in each stringer 70 are spaced apart and positioned in a row. The rows of apertures 80 in the upper and lower stringers 70 forming a support 56 are generally parallel. The apertures 80 permit the installation of elongate pivot rods 82 from a position outside of the interior space 71 of the stairway 24 for removable attachment to the steps 58 and stringers 70. The rods 82 are pushed through respective aligned apertures 80 and bores 78, thereby pivotally mounting the steps 58 to the stringers 70. Hitch pins 83 are installed in end portions of the rods 82 to secure the rods within the bores 78 and apertures 80. The steps 58 and the upper and lower stringers 70 of each support 56 thus form parallelograms on each side of the stairway 24 whereby the steps 58 move in unison in response to movement of one or more steps or stringers and maintain the angular relationship between themselves. The rods 82 form two generally horizontal pivot connections between each end 63L, 63R of each step 58 and the upper and lower stringers 70 of a respective support 56. Specifically, the steps 58 remain generally horizontal regardless of the angle of inclination of the stairway 24 and regardless of a mine convergence or divergence causing a longitudinal shift of an upper stringer relative to a lower stringer.

As seen in FIG. 3, a landing 85 is provided for facilitating transition from the top step 58 to the deck 34. In the illustrated structure, the landing 85 extends rearward from the back of the top step 58 and has an upper surface 86 that is coextensive with the top surface 59 and preferably generally parallel to the top surface 59. It is preferred that the landing 85 and top step 58 be an integral structure. A particularly important feature of the present invention is the use of the landing 85 to orient the position of the steps 58 generally horizontally. The landing 85 fixes the positions of the steps 58 so they are preferably inclined slightly downwardly from back edge 62 to front edge 61, as described above, and are generally horizontal end-to-end. The landing 85 is preferably secured on the top surface of the deck 34 with mechanical fasteners 88 such as bolts. In the erection of the air crosssing 22, the deck 34 can be fairly accurately positioned in a generally horizontal plane. The deck 34 will remain generally in its original generally horizontal orientation after installation. This allows for the angle of the top surfaces 59 of the steps 58 to be fixed and maintained without frequent adjustment to compensate for dimensional instability. By fixing the orientation of the landing 85 and top step 58, the orientation of the remaining steps 58 is fixed, regardless of the angle of inclination of the stringers 70 or stairway 24. The angular orientation of the steps 58 is thus not dependent on the condition or orientation of the mine floor 32 adjacent the lower end 52 of the stairway 25 nor is further excavation required at the lower end 52 to achieve a desired angular orientation of the steps. Alternatively, if the deck 34 of the air crossing is not as close to horizontal as desired or shifts, shims or the like (not shown) can be used between the landing 85 and deck 34 to position or reposition the landing as desired.

Figure 7:
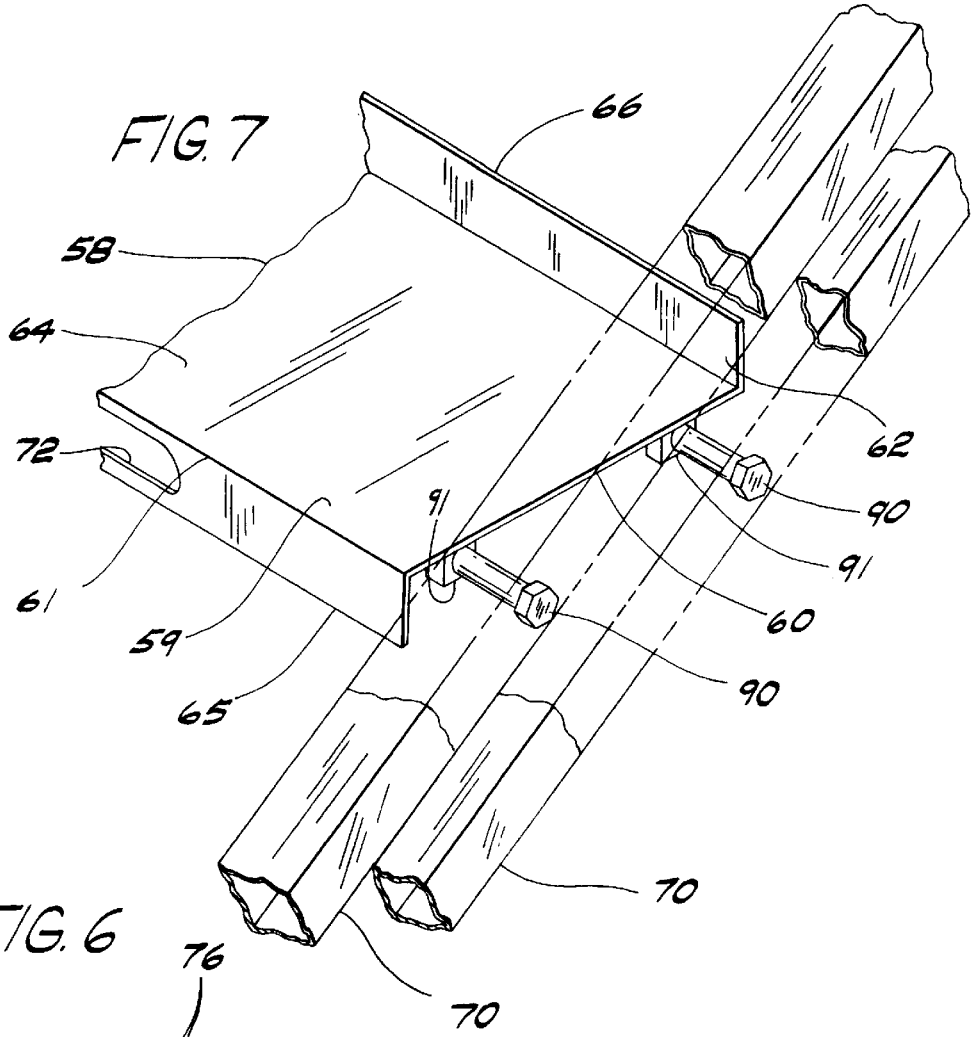
FIG. 7 is an enlarged fragmentary view of an alternative pivotal mount arrangement for mounting steps to the step supports.

In an alternative embodiment, as seen in FIG. 7, the steps 58 can be pivoted to the stringers 70 via threaded mechanical fasteners such as hex head bolts 90. In this embodiment, internally threaded members 91 are secured to the bottom surfaces 60 of the tread panels 64, similar to the channels 76 described above. The bolts 90 are installed through the apertures 80 in the stringers 70 from the outboard side to the inboard side (or interior 71) and threadably engaged with the members 91 to pivotally mount the steps 58 on the stringers 70. It is preferred that the bolts 90 be limited in axial movement within the members 91 to prevent binding against the stringers 70. One means of preventing binding is to have blind bottoms in the internally threaded bores of the members 91. The blind bottoms limit axial movement of the bolts 90 preventing their binding against the stringers 70 when tightened. Another means of preventing binding is to have the non-threaded sections of the bolts 90 sufficiently long that when the non-threaded portion engages the members 91 further axial movement is limited, preventing the bolts from binding against the stringers 70. By tightening the bolts 90 against the blind bottoms or the non-threaded portion, the bolts are frictionally retained to prevent loosening.

As best seen in FIGS. 3, 5, the stairway 24 includes a pair of spaced apart handrails, each designated generally as 94.

Figure 4:
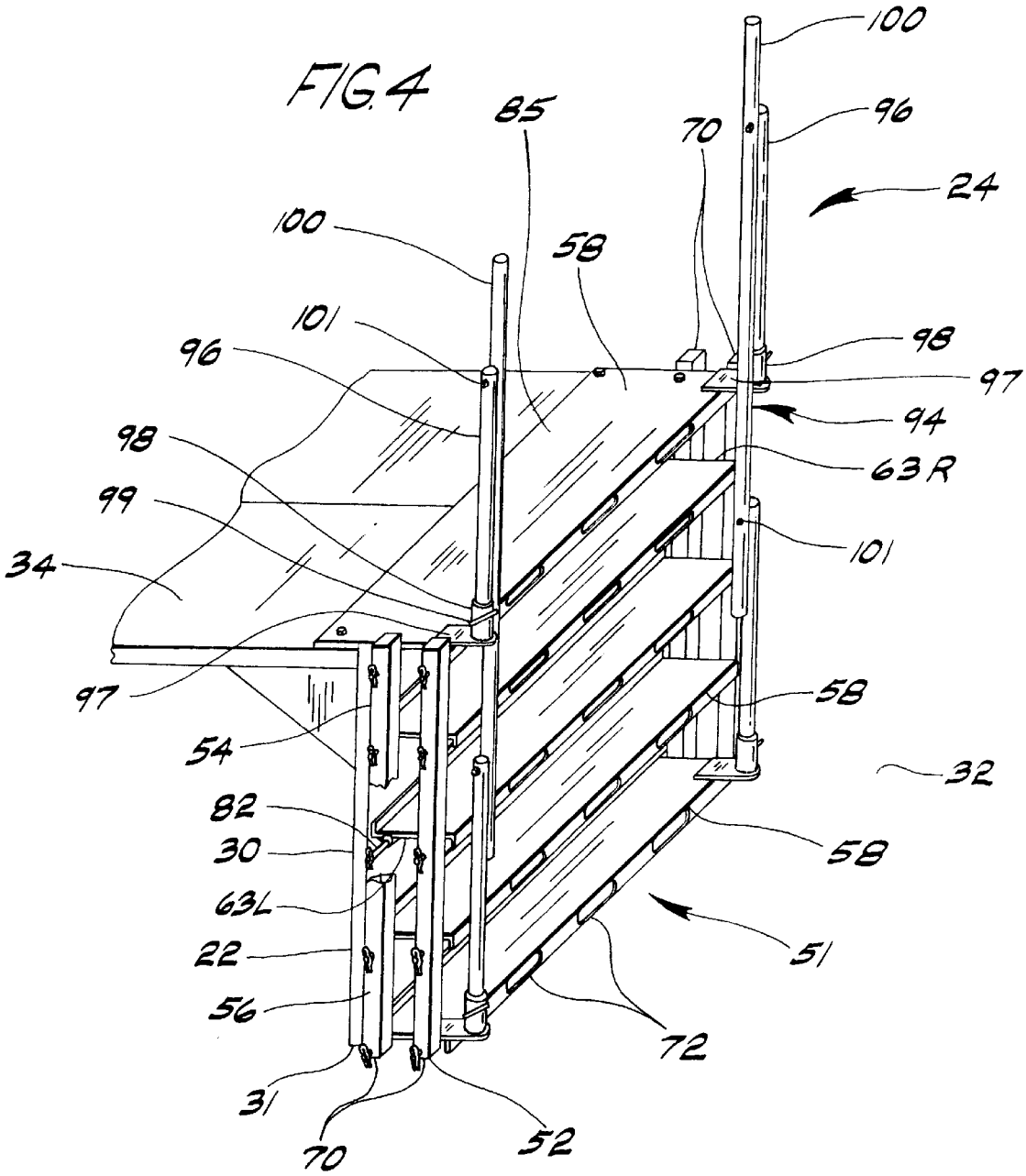
FIG. 4 is an enlarged perspective view of a stairway in a generally vertical orientation for use.
Figure 8:
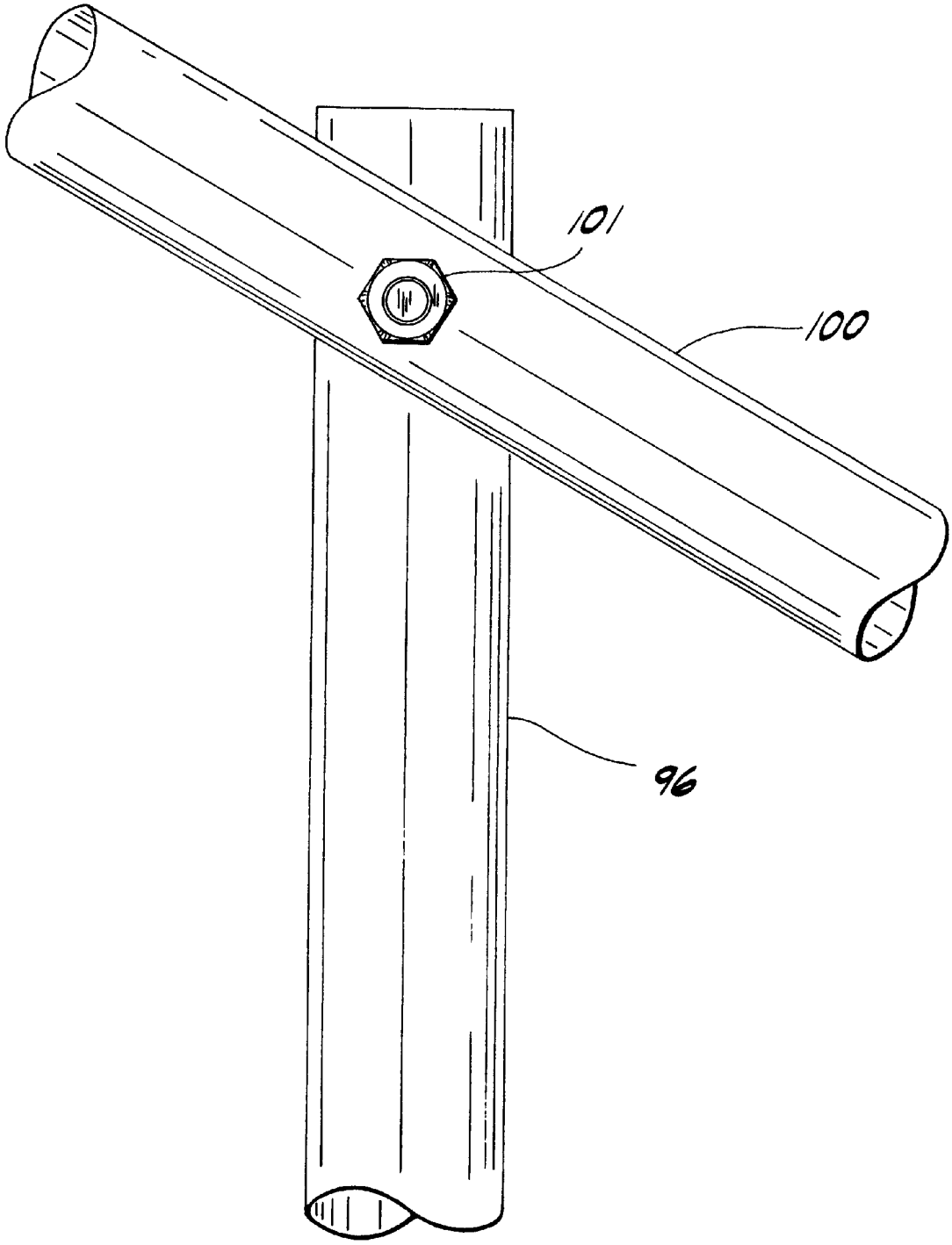
FIG. 8 is an enlarged fragmentary perspective view of the stairway showing details of a pivotal hand bar mount.

The handrails 94 are mounted for pivotal movement with the steps 58 relative to the stringers 70. As shown, each handrail 94 comprises a series of generally vertical posts 96 removably mounted on brackets 97 which are secured to the steps 58 inboard of and adjacent opposite ends 63L, 63R thereof. The brackets 97 are affixed, as by welding, to the tread panels 64 and extend outward or forward from the front edges 61 of the tread panels. The brackets 97 include tubular sockets 98 with upwardly opening generally vertical bores 95. The posts 96 have lower ends retained in the sockets 98 with T-handled set screws 99. The sockets 98 and posts 96 are positioned forward of the front edges 61 of the steps 58. By being positioned forward of the front edges 61, the posts 96 do not interfere with step movement even when the angle of inclination of the stairway 24 is vertical (FIG. 4). Further, the posts 96 are rigidly mounted on the steps 58 and are generally perpendicular to the top surfaces 59 whereby the posts 96 remain generally vertical regardless of the angle of inclination of the stringers 70. Each handrail 94 includes a hand bar or railing 100 pivotally mounted on the posts 96 by means of generally horizontal pivots 101 (FIG. 8), such as bolts and nuts. Preferably the hand bars 100 are positioned adjacent upper ends of respective posts 96. If desired, the hand bars 100 may be removed when the stairway 24 is in a generally vertical orientation allowing a stairway user to grasp the posts 96 while climbing the stairway, much like a ladder. The pivots 101 and post mountings to the steps are preferably of a knock down type to permit easy assembly and disassembly of the stairway in a mine 10.

Figure 9:
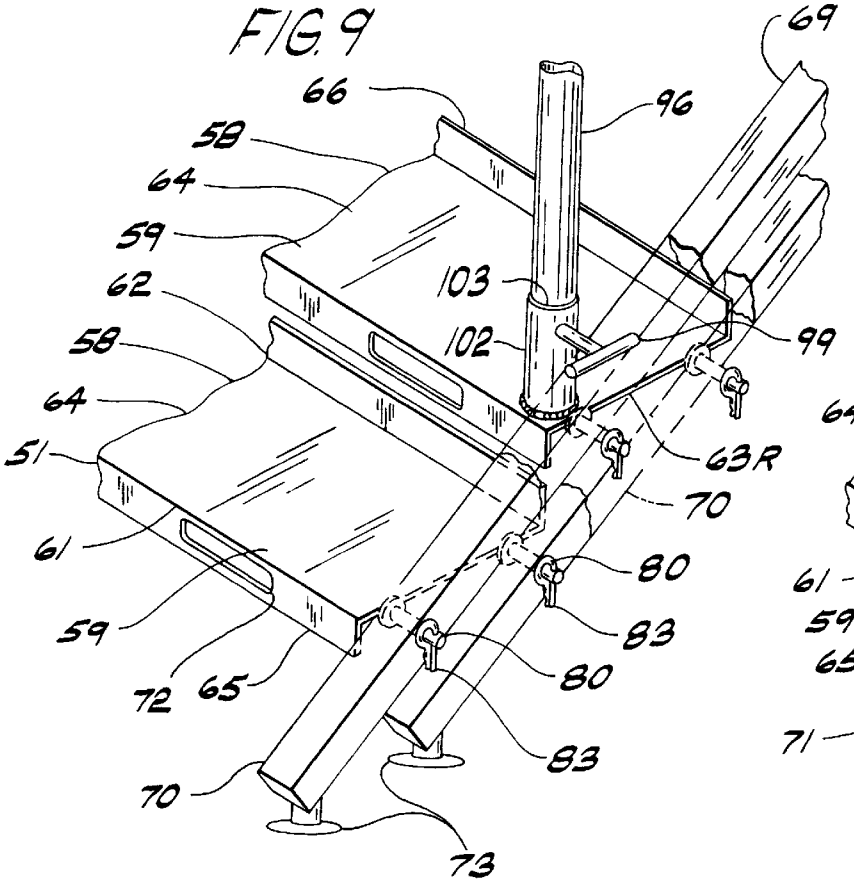
FIG. 9 is an enlarged fragmentary perspective view of the stairway showing details of an alternative handrail mount.

An alternate mount for the posts 96 is shown in FIG. 9. This post mount may be used when the stairway 24 will not be used in a vertical or near vertical orientation. Sockets 102 are secured to the steps 58, as by welding, and can be positioned on the tread panels 64 at locations similar to sockets 98, except they are not forward of the front edges 61. The sockets 102 have generally vertical post receiving bores 103 that are generally perpendicular to the top surfaces 59. The posts 96 are retained in the sockets 102 by T-handled set screws 99. It is desired to be able to use the stairway 24 at a variety of angles of inclination as measured from horizontal preferably in the range of about 30° to about 90° (generally vertical). It is envisioned, that the stairway could also be used at angles of inclination from generally vertical to generally horizontal. By having the width of the steps from front to back appropriately sized to prevent interference therebetween, and by having the back flange 66 downturned instead of upturned to eliminate a tripping hazard, the tread section 51 could be positioned where the stringers 70 are close to horizontal. The steps 58 would then form a substantially continuous ramp. A generally vertical orientation is seen in FIG. 4. The above described handrails 94 are constructed so as to not interfere with movement of the stringers 70 to the desired angle of inclination. Further, the hand rails 94 are mounted inboard of the stringers 70 in the interior 71 to help reduce the possibility of a miner or other personnel from inadvertently stepping on the top stringers 70 and slipping or losing balance.

Figure 10:
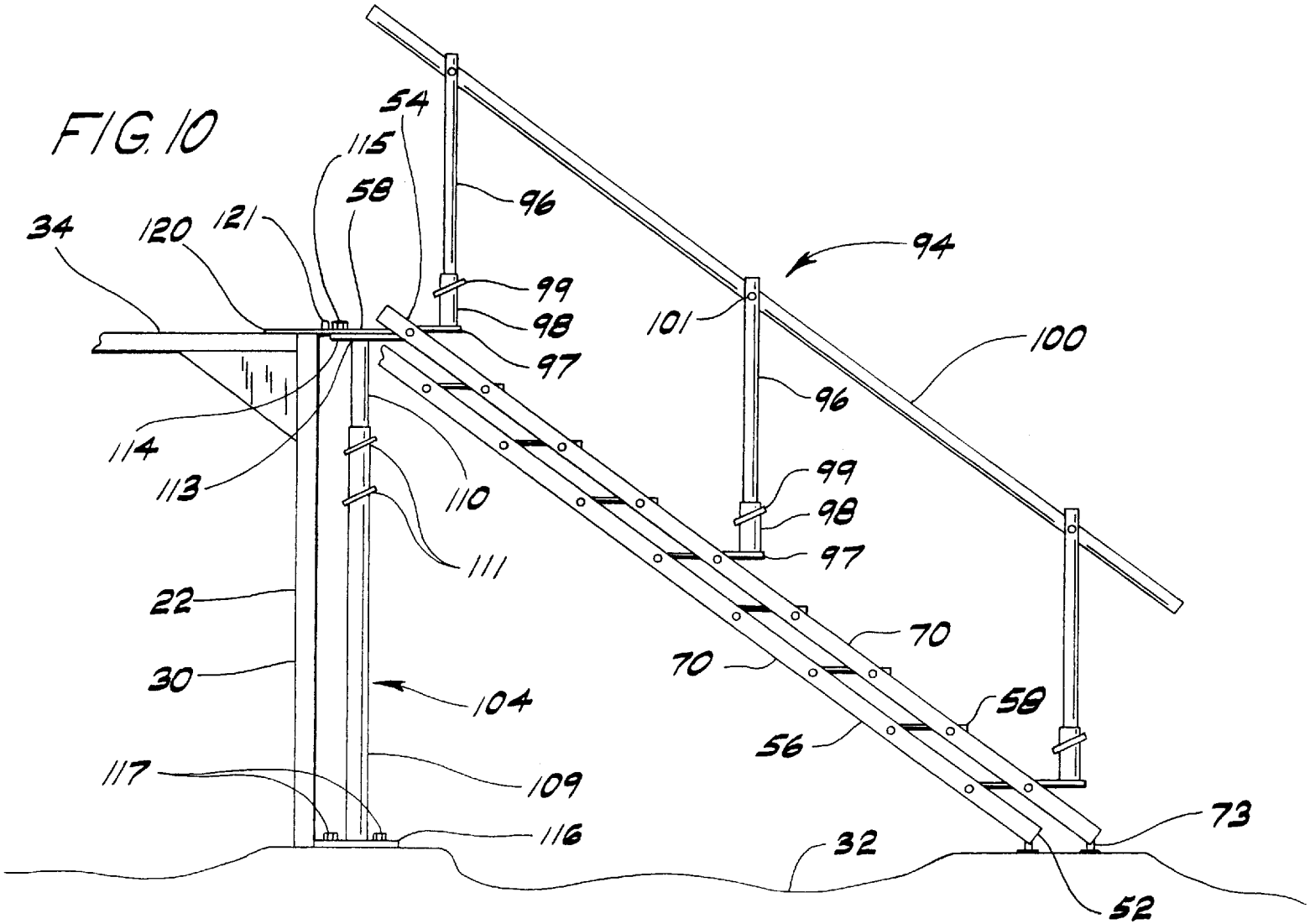
FIG. 10 is a side elevation view of a modified form of stairway utilizing adjustable columns for support.
Figure 14:
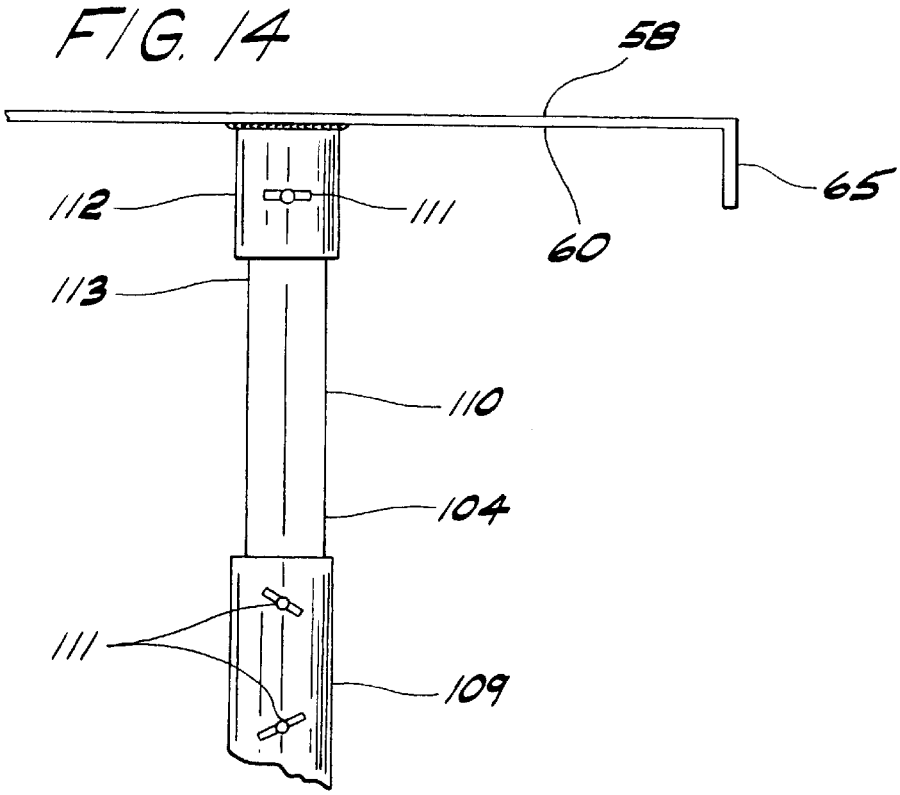
FIG. 14 is an enlarged fragmentary side view of an alternate mount for the support columns.

FIG. 10 shows an alternate embodiment in which the elevated or top end 54 of the stairway 24 is supported by telescoping support means that permits height adjustment of the upper end of the stairway. As shown, the telescoping support means includes a pair of spaced apart telescoping columns 104 having variable lengths. The columns 104 have lower sections 109 telescopically fitted with upper sections 110 to provide for height (length) adjustment. As shown, an upper section 110 is preferably mounted within a lower section 109 and axially movable therein. The lengths of the columns 104 are fixed with T-handled set screws 111 mounted on the lower sections 109. The upper ends 113 of the columns 104 are rigidly secured to the stairway 24, adjacent the upper end 54, at opposite ends of the top step 58. Preferably the upper ends 113 have anchor plates 114 secured thereto, as by welding, which are secured to the bottom surface 60 of the top step 58 as by mechanical fasteners 115 such as bolts and nuts to provide knock down capability for ease of assembly and disassembly. FIG. 14 shows an alternate means of securing the columns 104 to the stairway. As shown in FIG. 14, sleeves 112 are secured to the bottom of the steps 58 as by welding and open downwardly. The upper ends 113 of the columns 104 are secured in the sleeves with T-handled set screws 111. Fixing of the orientation of the columns 104 fixes the orientation of the steps 58. It is preferred that the columns 104 be generally perpendicular to the top step 58 whereby when the columns 104 are generally vertical, the steps 58 are generally horizontal. The height of the columns 104 and the length of the stringers 70 will determine the angle of inclination of the stairway 24. The columns 104 are preferably secured to the mine floor 32. As shown in FIG. 10, anchor plates 116 are secured to the lower ends 114 of the columns 104, as by welding. Mechanical fasteners 117, such as anchor bolts, secure the anchor plates 112 and hence the columns 104 to the floor 32.

A stairway 24 using columns 104 for support can be free standing or secured to the air crossing 22 for additional stability. A landing 120 can also be included to provide a smooth transition between the top step 58 and deck 34. The landing 120 can be hingedly mounted to the top step 58 as at 121 to allow relative pivotal movement between the deck 34 and top step 58 about a generally horizontal axis. The use of a column supported stairway 24 would be advantageous when the deck 34 is not a relatively flat deck, e.g., a squash culvert as discussed above. The hinged landing 120 could be made sufficiently long, front to back, to provide the necessary walkway from the top step 58 to the deck 34. The landing 120, by being hinged, would provide a smooth transition from the top step 58 to the deck 34 and accommodate different heights between the top step and deck.

Figure 11:
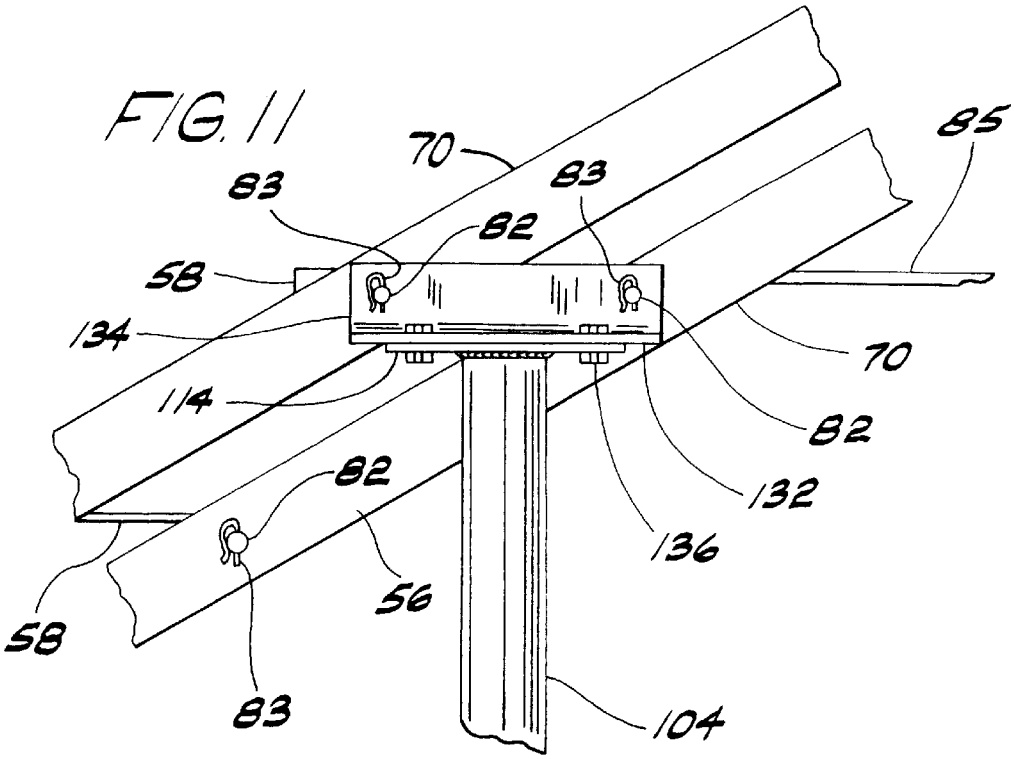
FIG. 11 is an enlarged fragmentary side view of an alternate mounting arrangement for the stairway.
Figure 12:
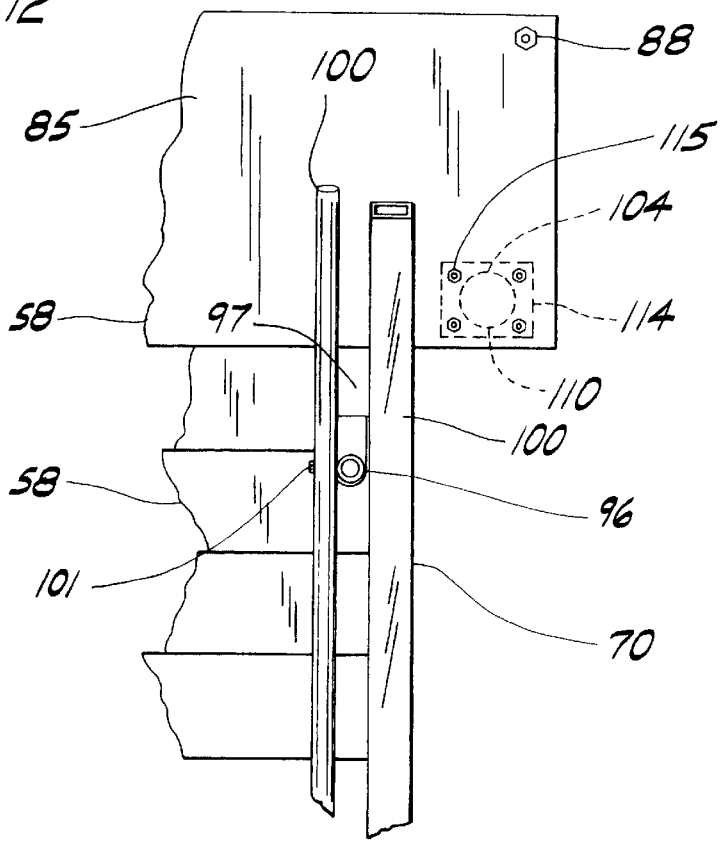
FIG. 12 is an enlarged fragmentary plan view of another alternate mounting arrangement for the stairway.

FIGS. 11, 12 illustrate alternative embodiments of the present invention having the columns 104 mounted to the stairway 24 on opposite sides thereof outboard of the interior 71. i.e., laterally outside the planes defined by the sets of stringers 70 and adjacent the upper end 54. FIG. 12 shows one of the columns 104 mounted on one side of the stairway 24. The other column 104 is similarly mounted to the stringers 70 on the other side of the stairway 24. An anchor plate 114, and hence the respective column 104 is secured to a bracket 130 that is preferably L-shaped having two flanges 132, 134. As shown, the anchor plate 114 is secured to the flange 132 as with mechanical fasteners 136 such as bolts and nuts. The flange 134 is pivotally mounted on a support 56 extending between the respective upper and lower stringers 70. Preferably the bracket 130 is mounted on the pivot rods 82 that pivotally mount the top step 58 to the stringers 70 by having the rods 82 extend through apertures (not shown) in the flange 134. Thus, the bracket 130 moves with the steps 58 as part of the parallelogram. Fixing the orientation of the flange 132 with the column 104 fixes the angle of the steps 58.

FIG. 12 shows a second form of outboard mounting for the columns 104. As shown, the landing 85 is adjacent the upper end 54 and extends laterally outward of each of the supports 56. The anchor plates 114 are rigidly affixed to the bottom surface of the landing 85 as with mechanical fasteners 140 such as bolts and nuts. Sleeves 112 could alternately be secured to the bottom of the landing 85 similar to their mounting on the steps 58 as seen in FIG. 14. T-handled set screws 111 can be used to affix the columns 104 to the landing 85. Preferably, the columns 104 are generally perpendicular to the steps 58 and landing 85. Fixing the orientation of the columns 104 fixes the orientation of the steps 58. When the columns 104 are generally vertical, the steps 58 are generally horizontal.

Figure 13:
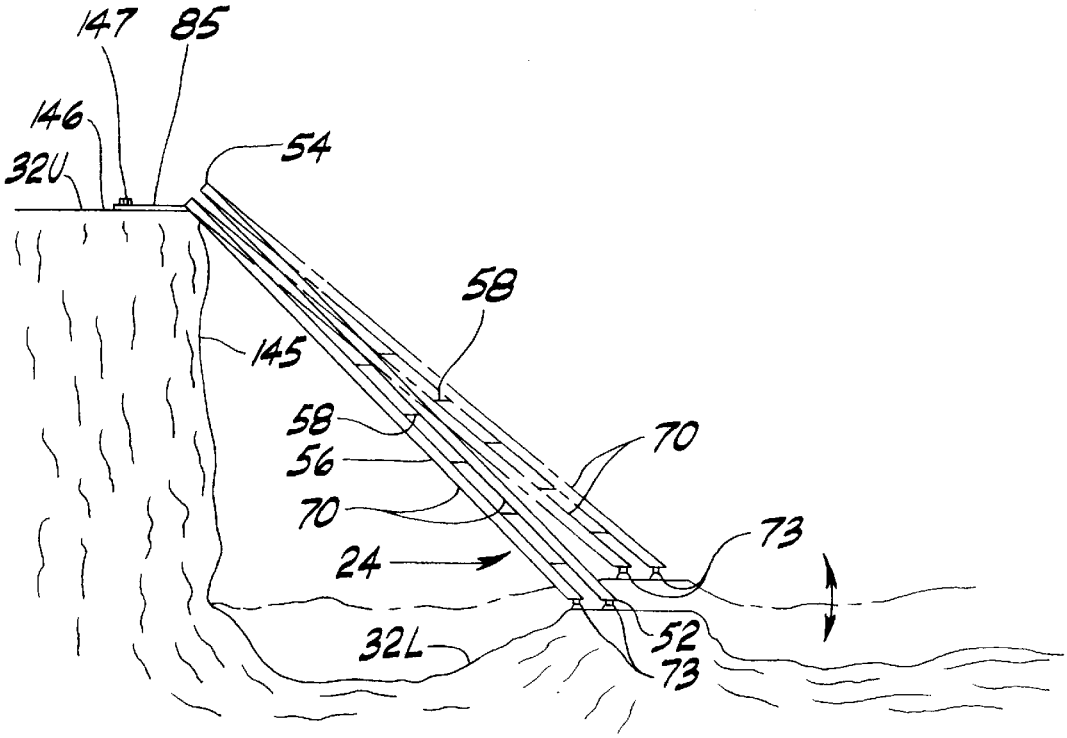
FIG. 13 is a schematic illustration of a stairway mounted on an air crossing showing the effect of the floor converging on the inclination of the stairway.

It will be apparent from the foregoing that the present invention provides an improved air crossing system 20 for use in a mine. The air crossing system 20 provides a pair of stairways 24 that automatically adjust to the mine floor 32 during installation of the stairway, keeping the steps 58 generally horizontal and automatically adjust for dimensional instability. FIG. 13 schematically illustrates movement of the stairway to a smaller angle of incline (the stairway shown in broken lines) due to the floor converging into the mine passageway 14. The stairways 24 are adapted for use at various angles of inclination without modification or remounting making them versatile in installation and use. Should the mine converge or diverge, the stairway 24 will automatically adjust to compensate for the dimensional instability while keeping the steps 58 generally horizontal. Should convergence or divergence become severe enough to affect the usability of the stairways 24, they can be easily adjusted to reorient the steps 58 to a generally horizontal orientation by remounting the landing 85 using shims or the like for adjustment or by adjusting the length of the columns 104. The knock-down structure permits easy assembly and disassembly in the mine. The handrails 94 are structured to permit their use at the various angles of inclination and do not interfere with movement of the stairway 24. The handbars 100 will remain generally parallel to the stringers 70 at the various angles of stairway inclination.

FIG. 13 also illustrates an additional embodiment of the present invention. The stairway 24 is also adapted to be used as a walkway between two mine floors, an upper mine floor 32U and a lower mine floor 32L. A portion of the mine floor 32U adjacent the edge 145 of the upper floor 32U can serve as a deck 146 and have the landing 85 secured thereto such as with anchor bolts 147. The deck 146 could be excavated to make it generally horizontal to fix the orientation of the steps 58 generally horizontal. The angle of landing 85 and the steps 58 could also be adjusted by the use of shims (not shown) between the landing 85 and deck 146. It is also envisioned that columns 104 could be used to support the stairway as shown in FIG. 10.

The stairway 24 can have different constructions. For example, the steps 58 could be channel shaped having two depending flanges instead of one depending flange 65 and one upstanding flange 66. The columns 104 could be screw-jacks like the ones used in basements to support floor beams. Other forms of the generally horizontal step pivots could also be used. For example, spring loaded pins could be mounted on the steps with the pins being biased to outwardly extending positions and retained in place with hitch pins or the like. The steps 58 could be inclined end-to-end, while still being generally horizontal, to permit water drainage therefrom.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A stairway for a mine air crossing installed in a mine passageway, comprising:

a pair of elongate generally parallel supports at opposite sides of the stairway, each support comprising upper and lower parallel stringers disposed one above the other at a respective side of the stairway;

a plurality of generally horizontal steps extending between the supports, each step having a front edge, a rear edge, and opposite ends positioned adjacent respective supports; two horizontal pivot connections between each end of each step and the upper and lower stringers of a respective support to form parallelograms at opposite sides of the stairway whereby said steps remain generally horizontal regardless of the angle of inclination of the stairway and regardless of a mine convergence or divergence causing a longitudinal shift of an upper stringer relative to a lower stringer; and handrails mounted on the steps at opposite sides of the stairway;

each handrail comprising a plurality of generally vertical posts each having a lower end attached to a respective step and an upper end, and a hand bar having generally horizontal pivot connections with the vertical posts adjacent their upper ends, said hand bars being removable from respective posts so that when the stairway is moved to a position in which said supports are vertical, said vertical posts of the handrails are positioned to be grasped by a person climbing the stairway.

2. A stairway for a mine air crossing installed in a mine passageway, comprising:

a pair of elongate generally parallel supports at opposite sides of the stairway, each support comprising upper and lower parallel stringers disposed one above the other at a respective side of the stairway, said supports having opposing inside faces defining an interior space therebetween;

a plurality of generally horizontal steps extending between the inside faces of the supports, each step having a front edge, a rear edge, and opposite ends;

two horizontal pivot connections between each end of each step and the upper and lower stringers of a respective support to form parallelograms at opposite sides of the stairway; and said horizontal pivot connections include knock-down connections configured for easy assembly and disassembly of the stairway, said knock-down connections comprising a plurality of holes in said stringers and a plurality of pivot members removably attachable to respective steps and stringers, said knock-down connections being securable from a position outside said interior space to facilitate assembly and disassembly of the stairway in a mine.

3. A stairway as set forth in claim 2 including handrails mounted on the steps at opposite sides of the stairway.

4. A stairway as set forth in claim 3 wherein said steps have bottom surfaces and said pivot members include elongate rods extending through the holes in the stringers and through channel members secured to the bottom surfaces of the steps.

5. A stairway as set forth in claim 3 wherein said steps having bottom surfaces and said pivot members including first threaded members extending through the holes in the stringers and threadably engaging second threaded members secured to the bottom surfaces of the steps.

6. A stairway as set forth in claim 5 wherein said first threaded members including bolts and said second threaded members including internally threaded members.

7. A stairway for a mine air crossing installed in a mine passageway, comprising:

a pair of elongate generally parallel supports at opposite sides of the stairway, each support comprising upper and lower generally parallel stringers disposed one above the other at a respective side of the stairway;

a plurality of generally horizontal steps extending between the supports, each step having a front edge, a rear edge, and opposite ends;

two generally horizontal pivot connections between each end of each step and the upper and lower stringers of a respective support to form parallelograms at opposite sides of the stairway, said upper and lower stringers of each parallelogram adapted to be freely longitudinally movable relative to one another after installation of the stairway to accommodate a change in the angle of inclination of the stairway, as during a mine convergence or divergence. without causing said steps to move out of their said generally horizontal position;

a generally horizontal landing attached to the supports adjacent upper ends thereof; and means for fastening the landing to an upper surface of the air crossing thereby to secure the stairway to the air crossing and set the angle of inclination of the steps.

8. A stairway as set forth in claim 7 including handrails mounted on the steps adjacent opposite sides of the stairway.

9. A stairway for a mine air crossing installed in a mine passageway, comprising:

a pair of elongate generally parallel supports at opposite sides of the stairway, each support comprising upper and lower parallel stringers disposed one above the other at a respective side of the stairway;

a plurality of generally horizontal steps extending between the supports, each step having a front edge, a rear edge, and opposite ends positioned adjacent respective supports;

two generally horizontal pivot connections between each end of each step and the upper and lower stringers of a respective support to form parallelograms at opposite sides of the stairway whereby said steps remain generally horizontal regardless of the angle of inclination of the stairway; and a pair of variable length columns, each mounted on a said step adjacent upper ends of the supports, said columns having lower ends for resting on a mine floor to at least partially support the steps and supports.

10. A stairway as set forth in claim 9 wherein the steps include a top step and the columns engage the top step.

11. A stairway as set forth in claim 10 including anchor plates secured to lower ends of the columns and adapted for securement to a mine floor.

12. A stairway as set forth in claim 11 including a landing extending rearward from said top step.

13. An air crossing system for a mine comprising:

a pair of generally vertical sidewalls with upper edges, said sidewalls being in spaced apart relation;

a deck extending between the sidewalls and secured thereto adjacent the upper edges of the sidewalls;

a stairway positioned adjacent at least one of the sidewalls and including a pair of elongate generally parallel supports at opposite sides of the stairway, each support comprising upper and lower stringers disposed one above the other at a respective side of the stairway, a plurality of generally horizontal steps extending between the supports, each step having a front edge, a rear edge, and opposite ends positioned adjacent respective supports, and two pivot connections between each end of each step and the upper and lower stringers of a respective support forming parallelograms at opposite sides of the stairway, each parallelogram having a first pair of parallel sides formed by said upper and lower stringers and a second pair of opposing sides formed by two of said steps held in fixed generally horizontal positions whereby upon a mine convergence or divergence, said upper and lower stringers shift longitudinally relative to one another and said steps remain in said generally horizontal positions.

14. An air crossing system as set forth in claim 13 wherein said stairway includes handrails mounted on the steps adjacent opposite sides of the stairway.

15. An air crossing system as set forth in claim 14 wherein said steps includes a top step, said air crossing system further comprising:

a generally horizontal landing extending rearward from said top step; and means for fastening the landing to an upper surface of the deck thereby to secure the stairway to the air crossing and set the angle of inclination of the steps.

16. A stairway for use with an elevated deck in a mine to form a walkway extending over an area to be traversed, said stairway comprising:

a pair of elongate supports at opposite sides of the stairway, each support comprising upper and lower stringers disposed one above the other at a respective side of the stairway;

a plurality of steps extending between the supports, each step having a front edge, a rear edge, and opposite ends positioned adjacent respective supports;

two generally horizontal pivot connections between each end of each step and the upper and lower stringers of a respective support to form parallelograms at opposite sides of the stairway permitting longitudinal shifting of said upper and lower stringers relative to one another after said stairway is installed and allowing said steps to remain in a generally fixed angular orientation relative to the deck regardless of the angle of inclination of the stairway and regardless of a mine convergence or divergence causing a longitudinal shift of an upper stringer relative to a lower stringer after installation of the stairway; and retaining means secured to at least one step of said stairway for retaining the steps in said fixed angular orientation relative to the deck.

17. A stairway as set forth in claim 16 further comprising:

handrails mounted on the steps adjacent opposite sides of the stairway; and each handrail comprising a plurality of generally vertical posts each having a lower end attached to a respective step and an upper end, and a hand bar having generally horizontal pivot connections with the posts adjacent their upper ends.

18. A stairway as set forth in claim 17 wherein said posts are positioned forward of the front edge of the steps on which they are attached.

19. A stairway as set forth in claim 17 wherein said pivot connections with each said stringer being in a row with the row of pivot connections in one said stringer being generally parallel to the row of pivot connections in the other stringer comprising a respective said support.

20. A stairway as set forth in claim 16 wherein said steps include a top step and said retaining means comprises a landing secured to said top step and adapted to be affixed to said deck.

21. A stairway as set forth in claim 16 wherein said steps include a top step and retaining means comprises a pair of height adjustable columns secured to said top step adjacent opposite ends of said top step.

22. A stairway as set forth in claim 16 wherein said retaining means includes a pair of brackets each secured to respective upper and lower stringers a respective support, said brackets each being part of a respective said parallelogram, said retaining means further includes a pair of height adjustable columns each rigidly affixed to a respective said bracket.

23. A stairway as set forth in claim 16 wherein said steps include a top step and said retaining means includes a landing extending rearward from said top step and further includes a pair of height adjustable columns rigidly affixed to said landing.

24. A stairway as set forth in claim 16 wherein each step inclines slightly downward from the back edge to the front edge.

25. A stairway as set forth in claim 24 wherein said incline is between about 1 to 3 degrees.

26. A stairway as set forth in claim 16 wherein said retaining means includes a landing extending rearward from said stairway and secured to the upper mine floor.

27. A stairway as set forth in claim 7 installed in mine wherein said steps have bottom surfaces and said connections are pivot connections including elongate rods extending through the holes in the stringers and through channel members secured to the bottom surfaces of the steps, said pivot connections being pivotal after installation of the stairway on the mine air crossing.

28. A stairway attached to an elevated deck in a mine to form a walkway extending over an area to be traversed, said stairway comprising:

a pair of elongate supports at opposite sides of the stairway, each support comprising upper and lower stringers disposed one above the other at a respective side of the stairway;

a plurality of steps extending between the supports, each step having a front edge, a rear edge, and opposite ends positioned adjacent respective supports;

two generally horizontal pivot connections between each end of each step and the upper and lower stringers of a respective support to form parallelograms at opposite sides of the stairway permitting longitudinal shifting of said upper and lower stringers relative to one another after said stairway is installed whereby said steps remain in a generally fixed angular position relative to the deck regardless of the angle of inclination of the stairway and regardless of a mine convergence or divergence causing a longitudinal shift of an upper stringer relative to a lower stringer after installation of the stairway; and retaining means secured to at least one step of said stairway for retaining the steps in said fixed angular position relative to the deck.

29. A stairway as set forth in claim 28 wherein said steps include a top step and said retaining means comprises a landing secured to said top step and adapted to be affixed to said deck.

30. A stairway as set forth in claim 28 wherein said steps include a top step and said retaining means comprises a pair of columns secured to said top step adjacent opposite ends of said top step.

31. A stairway as set forth in claim 28 wherein said retaining means includes a pair of brackets each secured to respective upper and lower stringers of a respective support, said brackets each being part of a respective said parallelogram, said retaining means further includes a pair of height adjustable columns each rigidly affixed to a respective said bracket.

32. A stairway as set forth in claim 28 wherein said steps include a top step and said retaining means includes a landing extending rearward from said top step and further includes a pair of columns rigidly affixed to said landing.

33. A stairway for use with an elevated deck in a mine to form a walkway extending over an area to be traversed, said stairway comprising:

a pair of elongate supports at opposite sides of the stairway, each support comprising upper and lower stringers disposed one above the other at a respective side of the stairway, the stringers having lower ends adapted to rest on a surface in the mine without fixed attachment thereto;

a plurality of steps extending between the supports, each step having a front edge, a rear edge, and opposite ends positioned adjacent respective supports; and two generally horizontal pivot connections between each end of each step and the upper and lower stringers of a respective support to form parallelograms at opposite sides of the stairway permitting longitudinal shifting of said upper and lower stringers relative to one another.

34. A stairway as set forth in claim 33 installed in a mine wherein longitudinal shifting of said upper and lower stringers relative to one another is permitted after installation.

35. A stairway as set forth in claim 33 further comprising retaining means secured to said stairway adjacent an upper end of the stairway for retaining the steps in a fixed angular position relative to the deck.

36. A stairway as set forth in claim 35 installed in a mine wherein said lower ends rest on a surface in the mine without fixed attachment thereto and wherein said upper and lower stringers are freely longitudinally movable relative to one another after installation of the stairway to accommodate a change in the angle of inclination of the stairway, as during a mine convergence or divergence, without causing said steps to move out of their said fixed angular position.

37. A stairway for a mine air crossing installed in a mine passageway, comprising:

a pair of elongate generally parallel supports at opposite sides of the stairway, each support comprising upper and lower parallel stringers disposed one above the other at a respective side of the stairway;

a plurality of steps extending between the supports, each step having a front edge, a rear edge, and opposite ends positioned adjacent respective supports;

two generally horizontal pivot connections between each end of each step and the upper and lower stringers of a respective support to form parallelograms at opposite sides of the stairway permitting longitudinal shifting of said upper and lower stringers relative to one another after said stairway is installed whereby said steps remain in the same angular position regardless of the angle of inclination of the stairway; and a pair of columns for supporting the stairway, said columns having lower ends for resting on a mine floor to at least partially support the stairway.

38. A stairway as set forth in claim 37 wherein the steps include a top step and the columns engage the top step.

39. A stairway as set forth in claim 37 including a landing extending rearward from said top step.

* * * * *